US008413377B2

(12) United States Patent
Koyama

(10) Patent No.: US 8,413,377 B2
(45) Date of Patent: Apr. 9, 2013

(54) LIQUID EJECTION HEAD AND LIQUID EJECTION APPARATUS INCLUDING THE SAME

(75) Inventor: Keita Koyama, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 76 days.

(21) Appl. No.: 13/034,221

(22) Filed: Feb. 24, 2011

(65) Prior Publication Data

US 2011/0316942 A1 Dec. 29, 2011

(30) Foreign Application Priority Data

Jun. 29, 2010 (JP) ..... 2010-147250

(51) Int. Cl.
*B41J 2/175* (2006.01)
*B41J 2/165* (2006.01)

(52) U.S. Cl.
USPC ..... 47/85; 347/29

(58) Field of Classification Search ..... 347/85, 347/7, 31, 34
See application file for complete search history.

(56) References Cited

U.S. PATENT DOCUMENTS 5,883,653 A * 3/1999 Sasaki ..... 347/86
6,135,590 A * 10/2000 Saeki et al. ..... 347/86
6,224,200 B1 * 5/2001 Higuma et al. ..... 347/86
6,270,193 B1 8/2001 Hiwada
6,293,658 B1 * 9/2001 Silverbrook ..... 347/85
7,101,027 B2 * 9/2006 Iijima et al. ..... 347/85
7,380,924 B2 * 6/2008 Silverbrook et al. ..... 347/85
7,658,482 B2 * 2/2010 Dyer et al. ..... 347/85
7,661,790 B2 * 2/2010 Harada et al. ..... 347/36
7,782,351 B2 * 8/2010 Kurose et al. ..... 347/238
7,883,170 B2 * 2/2011 Toyoda et al. ..... 347/17
(Continued)

FOREIGN PATENT DOCUMENTS

JP 05162329 A * 6/1993
JP H09-323414 A 12/1997
(Continued)

*Primary Examiner* — Matthew Luu
*Assistant Examiner* — Patrick King
(74) *Attorney, Agent, or Firm* — Scully, Scott, Murphy & Presser, P.C.

(57) ABSTRACT

A liquid ejection head including: a channel member including: a ejection openings; a liquid channel communicated with the ejection openings; and a liquid-supply opening for supplying liquid to the liquid channel; an ejection-energy applying portion configured to apply an ejection energy to the liquid in the liquid channel; an electronic part connected to the ejection-energy applying portion; a cover member defining an accommodating space with the channel member, the accommodating space accommodating the electronic part and at least a part of a liquid-supply pipe connected to the liquid-supply opening; and a liquid absorbing member disposed in the accommodating space so as to cover at least a part of a surface of the liquid-supply pipe; wherein the cover member has a through hole formed therein for communicating the accommodating space with an outside of the cover member; and wherein a part of the liquid absorbing member is exposed to the outside of the cover member from an entirety the through hole.

13 Claims, 8 Drawing Sheets

U.S. PATENT DOCUMENTS

| | | | | |
|---|---|---|---|---|
| 2003/0202057 | A1* | 10/2003 | Childs et al. | 347/85 |
| 2005/0146577 | A1* | 7/2005 | Sasaki et al. | 347/86 |
| 2005/0195251 | A1* | 9/2005 | Nishida et al. | 347/84 |
| 2006/0274131 | A1* | 12/2006 | Noguchi et al. | 347/85 |
| 2007/0229580 | A1 | 10/2007 | Chikamoto et al. | |
| 2007/0242109 | A1* | 10/2007 | Ito | 347/71 |
| 2008/0088666 | A1* | 4/2008 | Shindo et al. | 347/30 |
| 2009/0015640 | A1* | 1/2009 | Nishida et al. | 347/85 |
| 2010/0214379 | A1* | 8/2010 | Owaki et al. | 347/85 |

FOREIGN PATENT DOCUMENTS

| | | | | |
|---|---|---|---|---|
| JP | 2007-290353 | A | | 11/2007 |
| JP | 2009-323414 | A | | 9/2009 |
| JP | 2011038937 | A | * | 2/2011 |

* cited by examiner

LIQUID EJECTION HEAD AND LIQUID EJECTION APPARATUS INCLUDING THE SAME

CROSS REFERENCE TO RELATED APPLICATION

The present application claims priority from Japanese Patent Application No. 2010-147250, which was filed on Jun. 29, 2010, the disclosure of which is herein incorporated by reference in its entirety.

BACKGROUND OF THE INVENTION

1. Field of the Invention

The present invention relates to a liquid ejection head configured to eject liquid onto a recording medium to form an image on the recording medium, and to a liquid ejection apparatus including the liquid ejection head.

2. Description of the Related Art

There is conventionally known a recording head unit in which a potting material is filled, e.g., between a head holder (a cover member) and a reinforce frame for supporting a recording head such that ink does not enter into the recording head.

SUMMARY OF THE INVENTION

Where a supply pipe (e.g., a tube) for supplying a fluid (e.g., the ink) to the recording head is disposed so as to extend in the head holder, and the fluid (e.g., the ink) having a temperature lower than that of an outside of the supply pipe has flowed into the supply pipe, condensation may occur on a surface of the supply pipe. Liquid droplets formed by the condensation caused on the surface of the supply pipe in the head holder are accumulated in the head holder. Where the accumulated liquid droplets are attached or adhered onto electronic parts in the head holder, a failure of the electronic parts may be caused. Further, where the accumulated liquid droplets are attached or adhered onto a metal component in the head holder, the metal component may corrode.

This invention has been developed in view of the above-described situations, and it is an object of the present invention to provide a liquid ejection head and a liquid ejection apparatus including the liquid ejection head capable of absorbing condensation formed on an outer surface of a pipe in which a fluid flows to a liquid ejection head in the cover member and capable of discharging the absorbed condensation to an outside of the cover member.

The object indicated above may be achieved according to the present invention which provides a liquid ejection head comprising: a channel member including: a plurality of ejection openings for ejecting liquid; a liquid channel communicated with the plurality of the ejection openings; and a liquid-supply opening for supplying the liquid to the liquid channel; an ejection-energy applying portion fixed to the channel member and configured to apply an ejection energy to the liquid in the liquid channel for ejecting the liquid from the plurality of the ejection openings; an electronic part, connected to the ejection-energy applying portion, for driving the ejection-energy applying portion; a cover member defining an accommodating space with the channel member, the accommodating space accommodating the electronic part and at least a part of a liquid-supply pipe connected to the liquid-supply opening; and a liquid absorbing member disposed in the accommodating space so as to cover at least a part of a surface of the liquid-supply pipe; wherein the cover member has a through hole formed therein for communicating the accommodating space with an outside of the cover member; and wherein a part of the liquid absorbing member is exposed to the outside of the cover member from an entirety the through hole.

The object indicated above may also be achieved according to the present invention which provides a liquid ejection head comprising: a channel member including: a plurality of ejection openings for ejecting liquid; a liquid channel communicated with the plurality of the ejection openings; a liquid-supply opening for supplying the liquid to the liquid channel; a jet opening through which is jetted a humidified air for humidifying the plurality of the ejection openings; a first air channel communicated with the jet opening; a humidified-air supply opening for supplying the humidified air to the first air channel; a sucking opening for sucking the humidified air jetted from the jet opening; a second air channel communicated with the sucking opening; and a humidified-air discharge opening for discharging the humidified air from the second air channel; wherein the liquid ejection head further comprises: a liquid-supply pipe connected to the liquid-supply opening; a humidified-air supply pipe connected to the humidified-air supply opening; a humidified-air discharge pipe connected to the humidified-air discharge opening; an ejection-energy applying portion fixed to the channel member and configured to apply an ejection energy to the liquid in the liquid channel for ejecting the liquid from the plurality of the ejection openings; an electronic part, connected to the ejection-energy applying portion, for driving the ejection-energy applying portion; a cover member defining an accommodating space with the channel member, the accommodating space accommodating the electronic part and at least a part of at least one of the humidified-air supply pipe and the humidified-air discharge pipe; and a liquid absorbing member disposed in the accommodating space so as to cover at least a part of the at least one of the humidified-air supply pipe and the humidified-air discharge pipe accommodated in the accommodating space; wherein the cover member has a through hole formed therein for communicating the accommodating space with an outside of the cover member; and wherein a part of the liquid absorbing member is exposed to the outside of the cover member from an entirety the through hole.

The object indicated above may also be achieved according to the present invention which provides a liquid ejection apparatus comprising: the liquid ejection head; a tank storing the liquid to be supplied to the liquid ejection head; a liquid-supply portion configured to forcibly supply the liquid stored in the tank to the liquid-supply pipe; a liquid-discharge opening, formed in the channel member of the liquid ejection head, for discharging the liquid from the liquid channel; a liquid-discharge pipe connected to the liquid-discharge opening and communicated with the tank; an opening and closing valve provided in the liquid-discharge pipe; and a controller configured to control a drive of the liquid-supply portion and the opening and closing valve; wherein the controller is configured to drive the liquid-supply portion in a state in which the opening and closing valve is opened and to circulate the liquid such that the liquid passes through the tank, the liquid-supply pipe, the liquid channel, the liquid-discharge pipe, and the tank in order.

In the liquid ejection heads and the liquid ejection apparatus constructed as described above, even where a condensation has occurred on an outer surface of the liquid-supply pipe in the accommodating space, the liquid absorbing member can absorb the condensation and vaporize the absorbed condensation to the outside of the cover member via the through hole. Accordingly, it is possible to prevent a failure of the electronic part due to an attachment of the liquid to the electronic part.

BRIEF DESCRIPTION OF THE DRAWINGS

The objects, features, advantages, and technical and industrial significance of the present invention will be better understood by reading the following detailed description of an embodiment of the invention, when considered in connection with the accompanying drawings, in which.

DETAILED DESCRIPTION OF THE EMBODIMENT

Hereinafter, there will be described an embodiment of the present invention by reference to the drawings.

Figure 1:
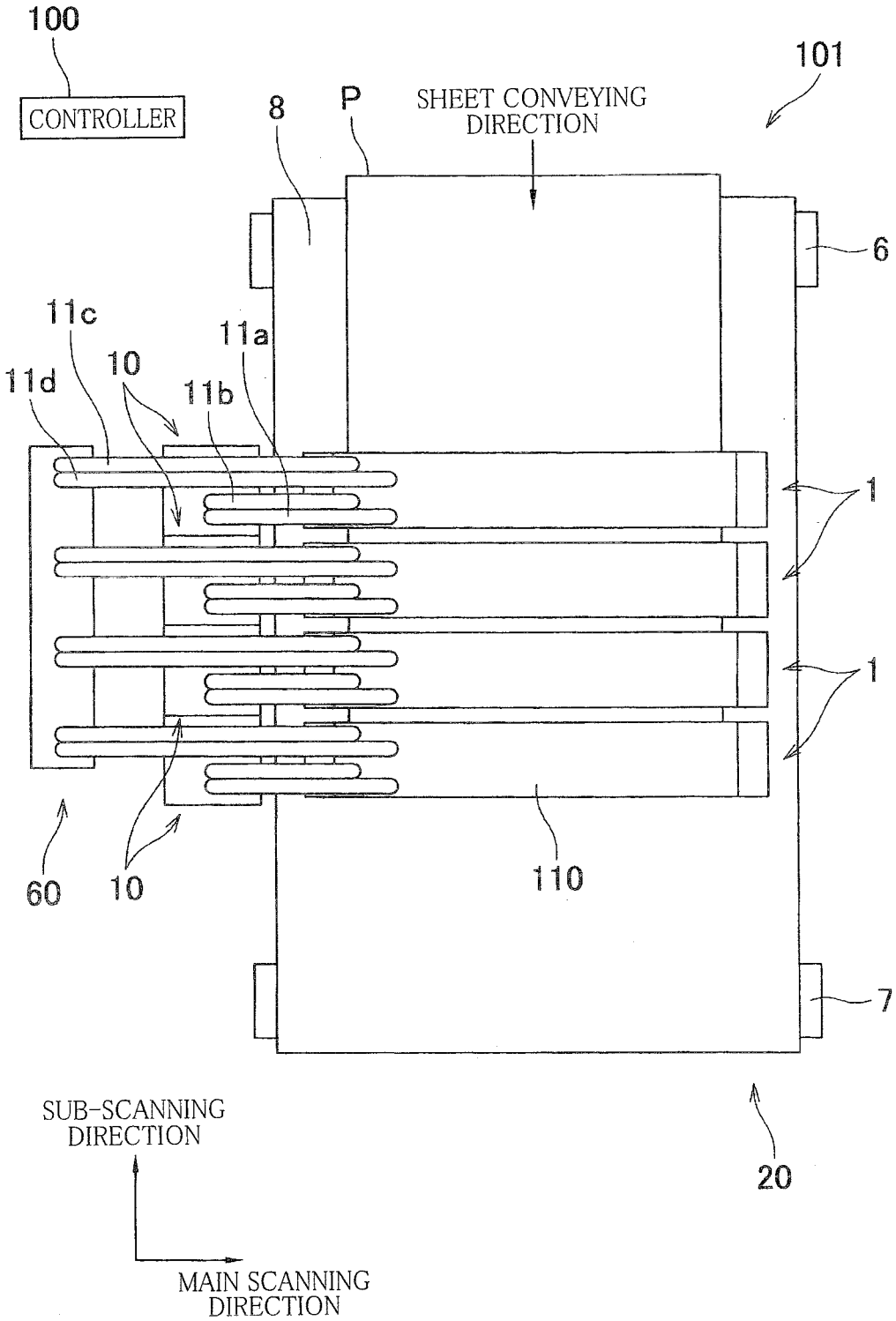
FIG. 1 is a plan view generally showing an ink-jet printer as an embodiment of the present invention.
Figure 5:
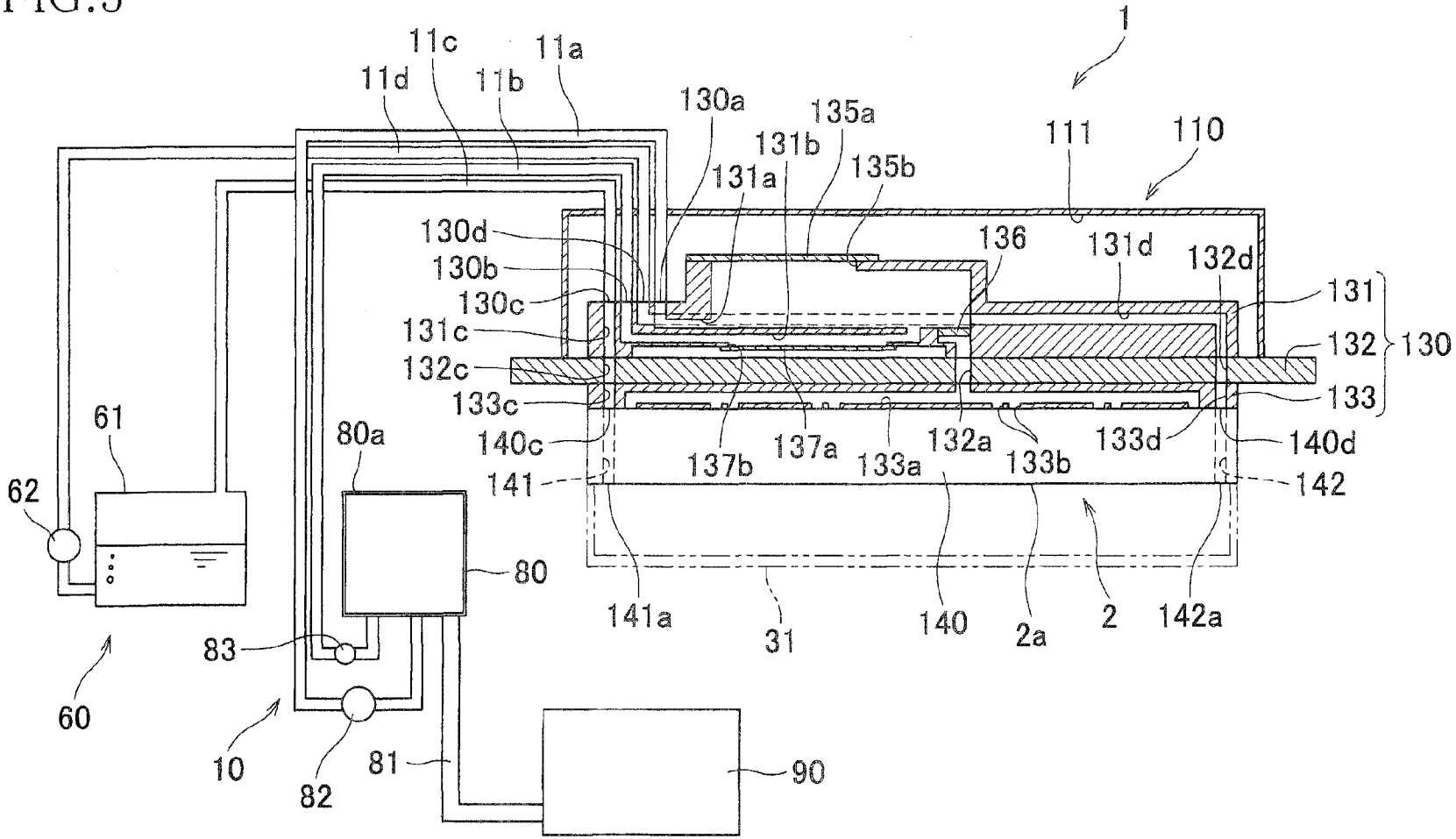
FIG. 5 is a block diagram generally showing constructions of inner channels of the ink-jet head, an ink supply unit, and a humidifier unit.

As shown in FIG. 1, an ink-jet printer 101 includes a conveying unit 20, four ink-jet heads 1, four ink supply units 10, four caps 31, a cap moving mechanism, not shown, a humidifier unit 60, and a controller 100. The conveying unit 20 conveys or feeds a sheet P in a sheet conveying direction (from an upper side toward a lower side in FIG. 1). The four heads 1 eject ink droplets of respective inks of four colors (namely, magenta, cyan, yellow, and black), onto the sheet P conveyed by the conveying unit 20. The four ink supply units 10 respectively supply the inks to the heads 1. The four caps 31 respectively cover ejection faces 2*a* of the respective heads 1. It is noted that FIG. 5 shows one of the caps 31. The cap moving mechanism moves the caps 31. The humidifier unit 60 is used for a humidifying (moisturizing) maintenance. The controller 100 controls entire operations of the ink-jet printer 101.

The controller 100 includes a Central Processing Unit (CPU), an Electrically Erasable and Programmable Read Only Memory (EEPROM), and a Random Access Memory (RAM). The EEPROM rewritably stores therein programs executed by the CPU and data used for the programs. The RAM temporarily stores therein data when the programs are executed. Components constituting the controller 100 are configured by cooperating these hardware and software in the EEPROM.

It is noted that, in the present embodiment, the sub-scanning direction is a direction parallel to the sheet conveying direction in which the sheet P is conveyed by the conveying unit 20, and the main scanning direction is a direction perpendicular to the sub-scanning direction and along a horizontal plane.

The conveying unit 20 includes two belt rollers 6, 7 and an endless conveying belt 8 wound around the rollers 6, 7 so as to extend between the rollers 6, 7. The belt roller 7 is a drive roller rotated by a drive power transmitted from a convey motor, not shown. The rotation of the belt roller causes the conveying belt 8 to rotate or run. The belt roller 6 is a driven roller rotated with the rotation or the running of the conveying belt 8. The sheet P placed on an outer circumferential face of the conveying belt 8 is conveyed to a downstream side in the convey direction (toward the lower side in FIG. 1).

The four heads 1 extend in the main scanning direction and are arranged in the sub-scanning direction in parallel with one another. That is, the ink-jet printer 101 is a line-type color ink-jet printer in which ejection openings 108 for ejecting the ink droplets are formed in a lower face of each head 1 and arranged in the main scanning direction. The lower face of each head 1 functions as the ejection face 2*a* (see FIGS. 4 and 8).

The outer circumferential face of an upper portion of the conveying belt 8 and the ejection faces 2*a* face each other so as to be parallel to each other. When the sheet P conveyed by the conveying belt 8 passes just under the four heads 1, the controller 100 controls the heads 1 to eject the ink droplets of the respective color in order onto an upper face of the sheet P. As a result, a desired color image is recorded or formed on the sheet P.

The ink supply units 10 are respectively connected to the heads 1 via ink supply tubes (liquid-supply pipes) 11*a* and ink discharge tubes (liquid-discharge pipes) 11*b*. The humidifier unit 60 is also connected to the heads 1 respectively via air supply tubes (humidified-air supply pipes) 11*c* and air (humidified air) discharge tubes (pipes) 11*d*.

Figure 2:
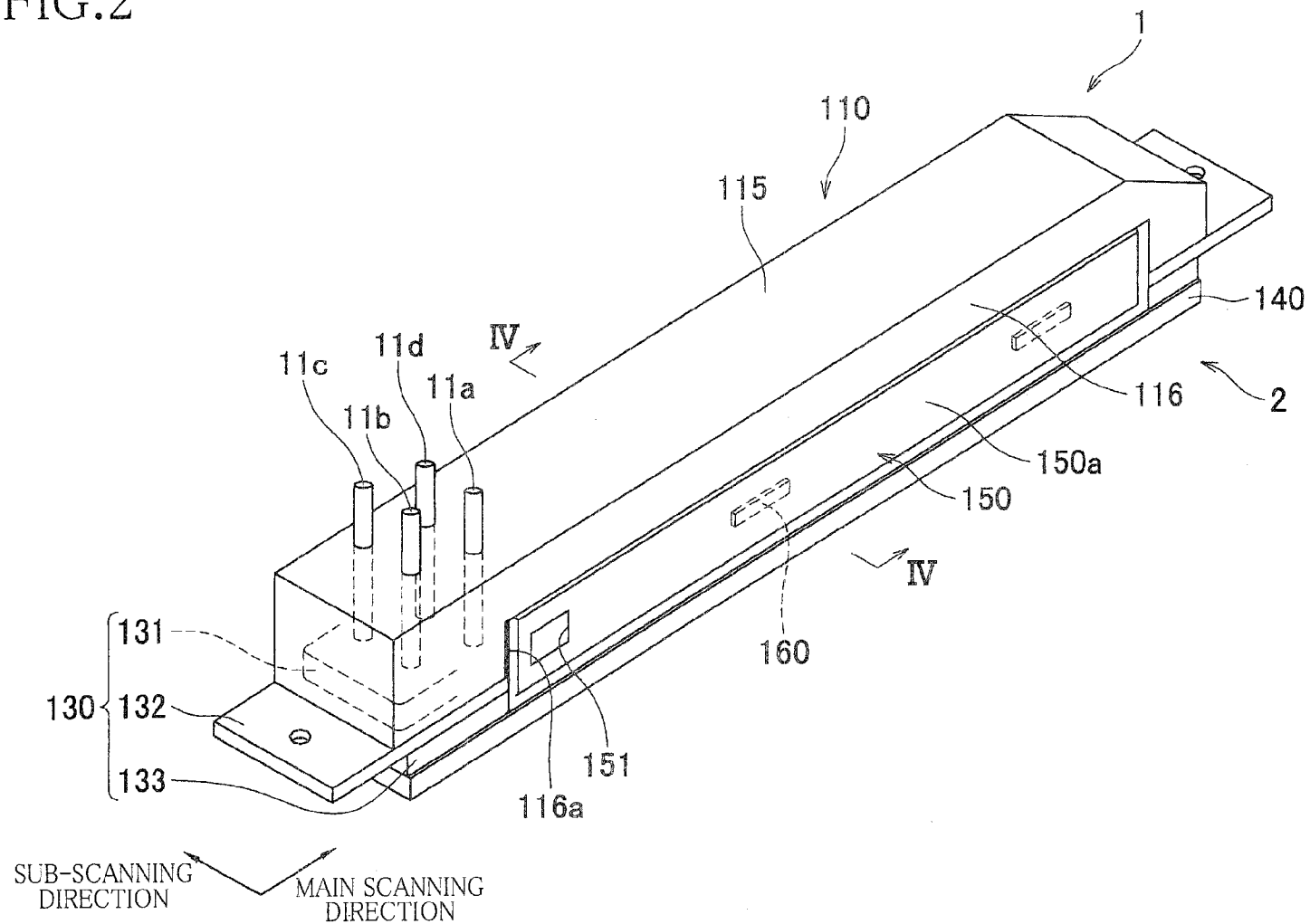
FIG. 2 is a perspective view generally showing an ink-jet head shown in FIG. 1.
Figure 3:
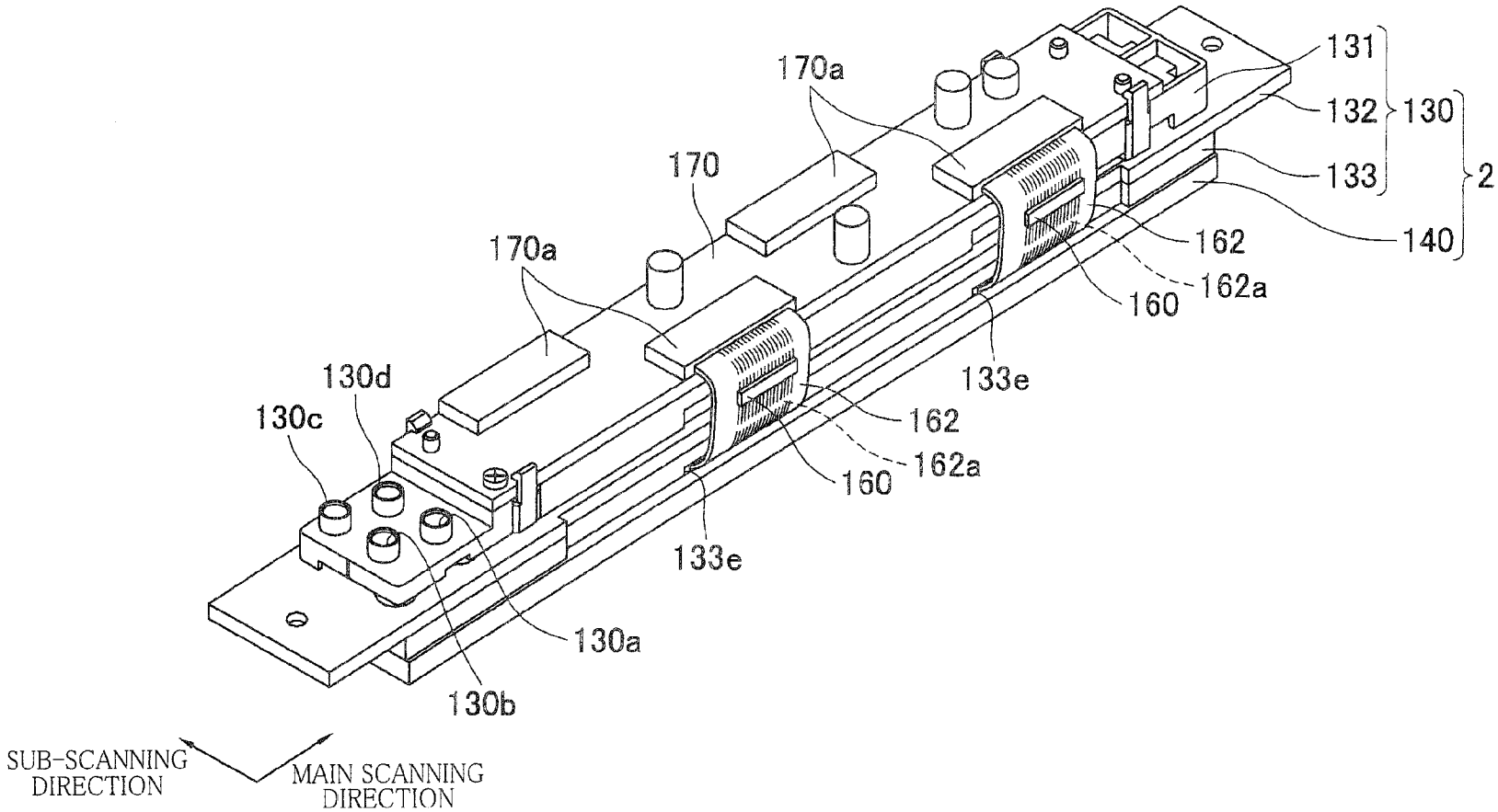
FIG. 3 is a perspective view showing an internal construction of the ink-jet head shown in FIG. 2.
Figure 4:
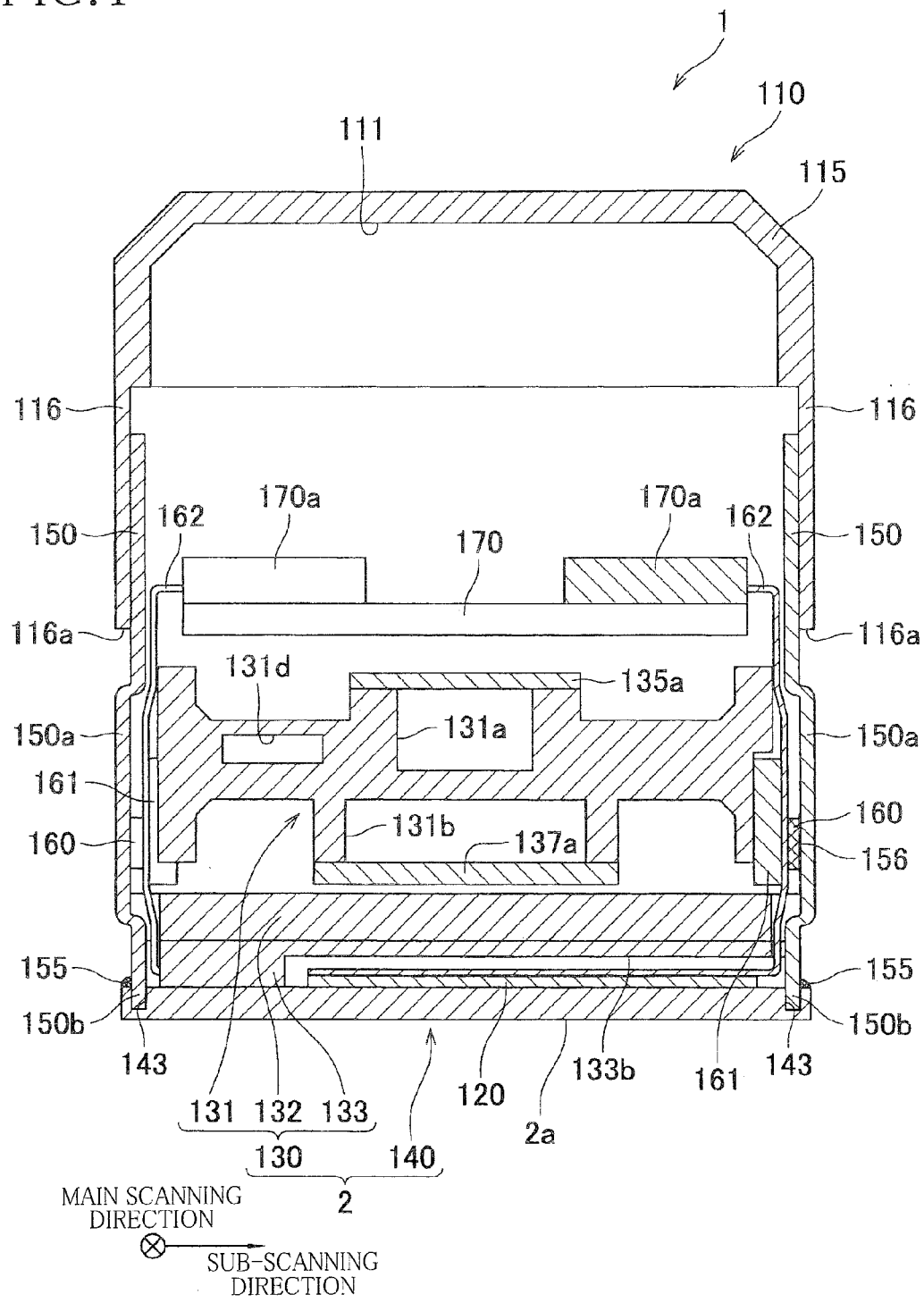
FIG. 4 is a cross-sectional view of the ink-jet head taken along a line IV-IV in FIG. 2.
Figure 6A:
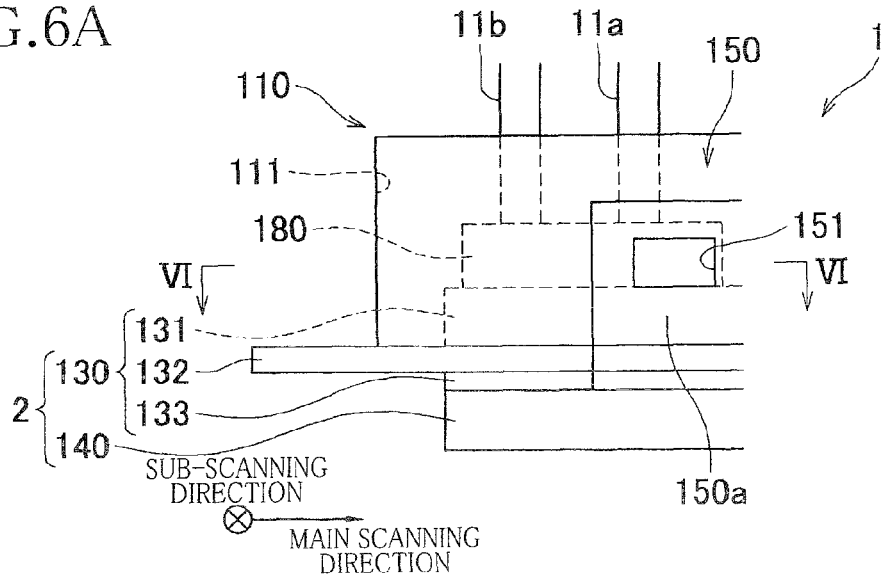
FIG. 6A is a side view showing a main portion of the ink-jet head shown in FIG. 2.
Figure 6B:
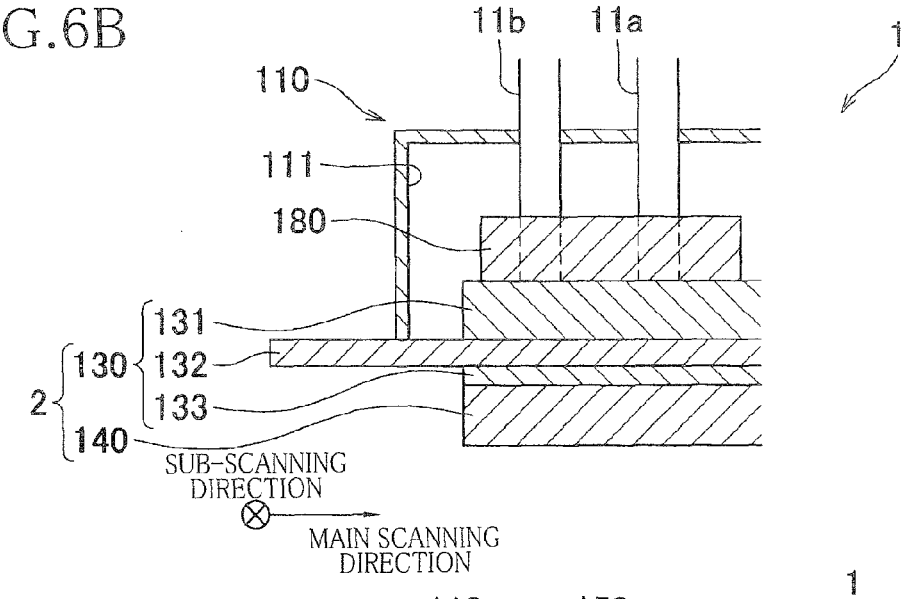
FIG. 6B is a partial cross-sectional view of the ink-jet head shown in FIG. 2.
Figure 6C:
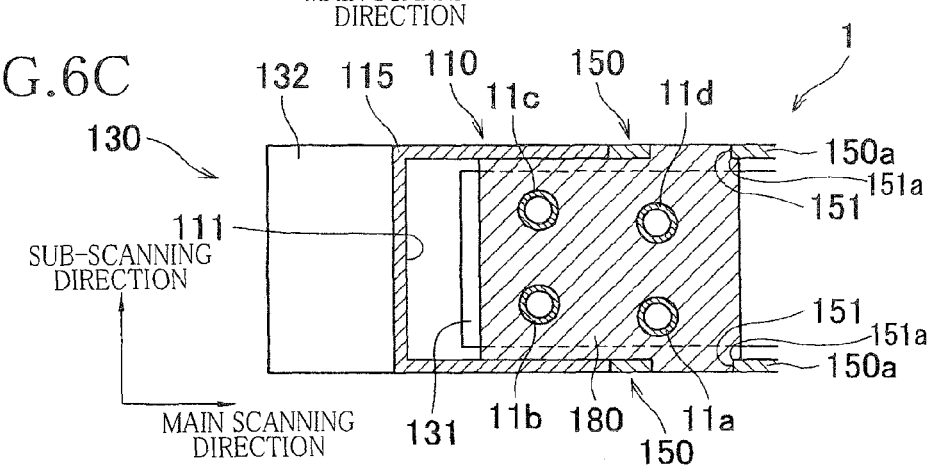
FIG. 6C is a cross-sectional view of the ink-jet head taken along a line VI-VI in FIG. 6A.
Figure 7:
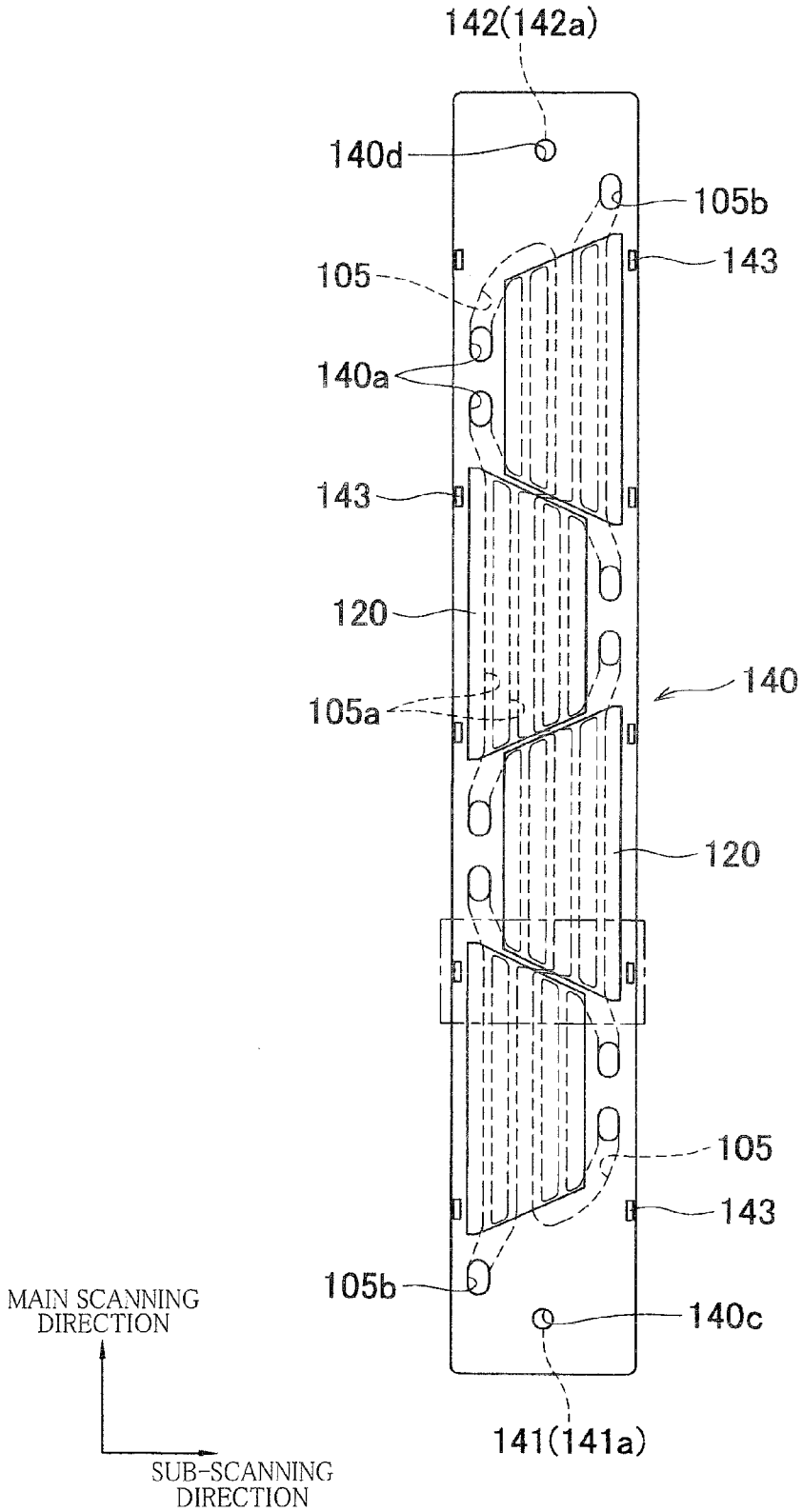
FIG. 7 is a plan view showing actuator units and a channel unit shown in FIG. 4.

There will be next explained the heads 1 in greater detail with reference to FIGS. 2-8. It is noted that since the heads 1 have the same construction, the explanation below is given for one head 1 for the sake of simplicity. As shown in FIGS. 2-4, the head 1 includes a channel member 2, a cover member 110, and a control board 170. The channel member 2 includes a reservoir unit 130 and a channel unit 140 so as to provide therein (a) ink (liquid) channels through which the ink flows and (b) air channels through which the humidified air flows. Further, as shown in FIG. 7, the head 1 includes four actuator units 120 fixed on an upper face of the channel unit 140. Each of the actuator units 120 is an example of an ejection-energy applying portion.

As shown in FIGS. 2 and 4, the cover member 110 includes (a) a head cover 115 having a generally box-like shape opening downward and (b) two heat sinks 150. The cover member 110 is disposed so as to provide an accommodating space 111 on an upper side of the channel unit 140. As shown in FIG. 4, in this accommodating space 111, there are disposed the reservoir unit 130, the actuator units 120, driver ICs 160 each as one example of electronic parts which will be described below, the control board 170, and so on.

As shown in FIG. 2, there are provided the ink supply tube 11*a*, the ink discharge tube 11*b*, the air supply tube 11*c*, and the air discharge tube 11*d* so as to extend through the head cover 115 from an upper side of the head cover 115 to the accommodating space 111. That is, parts of the respective tubes 11*a*-11*d* are disposed in the accommodating space 111. These tubes 11*a*-11*d* are respectively connected to four openings 130*a*, 130*b*, 130*c*, 130*d* (see FIG. 3) formed in the reservoir unit 130. It is noted that the opening 130*a* is an ink (liquid) supply opening, the opening 130*b* is an ink (liquid)

discharge opening, the opening 130*c* is an air (humidified air) supply opening, and the opening 130*d* is an air (humidified air) discharge opening.

Further, the head cover 115 includes side walls 116 respectively expanding in an upward and downward direction toward opposite edge portions of the channel unit 140 in the sub-scanning direction. Rectangular openings 116*a* extending in the main scanning direction are respectively formed in these side walls 116. Each opening 116*a* is a cutout formed so as to expand from a lower end of the corresponding side wall 116 to a central portion of the same 116 in the upward and downward direction. The openings 116*a* are respectively for exposing, from the head cover 115, flat projecting portions 150*a* formed on the respective heat sinks 150.

Each heat sink 150 is a plate member formed of an aluminum metal. The rectangular flat projecting portion 150*a* is formed on a central portion of each heat sink 150 so as to extend in the main scanning direction. As shown in FIG. 4, the flat projecting portions 150*a* project outward from the channel unit 140 in the sub-scanning direction. The flat projecting portions 150*a* are formed by performing press working on a metal flat plate, for example. Since the flat projecting portions 150*a* are respectively formed on the heat sinks 150, stiffness of each heat sink 150 is improved.

As shown in FIG. 2, through holes 151 are respectively formed through the flat projecting portions 150*a* of the respective heat sinks 150 in a thickness direction of the flat projecting portions 150*a*. Each of the through holes 151 is formed in a left end portion of the corresponding flat projecting portion 150*a* in FIG. 2 so as to face a corresponding one of the tubes 11*a*, 11*d* in the sub-scanning direction. It is noted that, as shown in FIG. 6, the through hole 151 formed in each heat sink 150 has an opening 151*a* which is opened inside the cover member 110 (and which faces the accommodating space 111). Specifically, the opening 151*a* expands along a boundary between the accommodating space 111 and an inner face of the cover member 110 in which the through hole 151 is formed. Each opening 151*a* is entirely covered and closed by a liquid absorbing member 180 which will be explained below.

As shown in FIG. 4, five projections 150*b* projecting downward are formed on a lower end portion of each heat sink 150 so as to be arranged in the main scanning direction. The five projections 150*b* are respectively fitted in five recessed portions 143 (see FIG. 7) formed in a corresponding one of end portions of the channel unit 140 in the sub-scanning direction. As a result, the heat sinks 150 stand upright from the upper face of the channel unit 140. The two heat sinks 150 face each other in the sub-scanning direction. As shown in FIG. 4, at an upper end portion of each of the heat sinks 150, an outer face of the heat sink 150 is held in contact with an inner face of the side wall 116 of the head cover 115.

In the head 1, clearances each between any two of components are sealed by a potting material 155 such that the accommodating space 111 defined by the cover member 110 and the channel unit 140 becomes a generally sealed space (noted that the potting material 155 is illustrated only at boundary areas between the heat sinks 150 and the channel unit 140). Since the heat sinks 150 are held in sealed contact with the channel unit 140 and the head cover 115, the potting material 155 never enters into the sealed space.

As shown in FIGS. 3 and 4, the control board 170, for controlling the actuator units 120, is fixed on an upper side of the reservoir unit 130. Four connectors 170*a* are fixed to an upper face of the control board 170. The connectors 170*a* are electrically connected to various processors and storage devices mounted on the control board 170. The four connectors 170*a* are arranged in the main scanning direction in two arrays in a staggered fashion.

One end of each of FPCs 162 is connected to a side face of a corresponding one of the connectors 170*a*. Each FPC 162 is a flexible sheet member and electrically connects between a corresponding one of the actuator units 120 and the control board 170. Wirings 162*a* are formed in each FPC 162. As shown in FIG. 4, the FPC 162 extends downward from the respective connectors 170*a* along side faces of the reservoir unit 130 so as to pass through respective recessed portions 133*e* formed in the reservoir unit 130. In each recessed portion 133*e*, the other end of the FPC 162 is electrically connected to the actuator unit 120. Further, the driver ICs 160 are mounted on the respective FPCs 162 so as to be electrically connected to the wirings 162*a*.

Each of the driver ICs 160 is an IC chip for driving a corresponding one of the actuator units 120. As shown in FIG. 4, each driver IC 160 is urged or pressed, at a position facing a corresponding one of the heat sinks 150, to the corresponding heat sink 150 with the corresponding FPC 162 by a corresponding one of sponges 161 provided on one of side walls of the reservoir unit 130. Each of heat dissipating sheets 156 sticks or adheres on an inner face of a corresponding one of the heat sinks 150 at a position facing a corresponding one of the driver ICs 160. The driver ICs 160 are respectively held in close contact with the heat sinks 150 via the heat dissipating sheets 156. As a result, each driver IC 160 and the corresponding heat sink 150 are thermally connected to each other.

The reservoir unit 130, for supplying the ink to the channel unit 140, is fixed to the upper face of the channel unit 140. The reservoir unit 130 includes an upper reservoir 131, a reservoir base 132, and a lower reservoir 133. As shown in FIG. 5, in the upper reservoir 131, there are formed an ink inflow channel 131*a* (as an example of a liquid channel), an ink discharge channel 131*b*, an air inflow channel 131*c*, and an air discharge channel 131*d*. The ink inflow channel 131*a* and the ink discharge channel 131*b* partly constitute the ink channels, and the air inflow channel 131*c* and the air discharge channel 131*d* partly constitute the air channels. It is noted that, in FIG. 5, an ink supply opening 130*a* (as an example of a liquid-supply opening), an ink discharge opening 130*b* (as an example of a liquid-discharge opening), a humidified-air supply opening 130*c*, and a humidified-air discharge opening 130*d* are arranged in the main scanning direction for easier understanding purpose.

The ink inflow channel 131*a* is a channel into which the ink supplied from the ink supply units 10 flows or enters via the ink supply tube 11*a* and the ink supply opening 130*a*. The ink inflow channel 131*a* functions as an ink reservoir temporarily storing the ink having flowed into the ink inflow channel 131*a*. In an inner wall face of the ink inflow channel 131*a* is formed a hole 135*b* which extends through an outer wall face of the upper reservoir 131. The hole 135*b* is sealed by a flexible resin film 135*a* from a side thereof nearer to the outer wall face of the upper reservoir 131. The resin film 135*a* defines a part of the inner wall face of the ink inflow channel 131*a*. The resin film 135*a* is displaced with a variation of an ink pressure in the ink inflow channel 131*a*, thereby functioning as a damper for restraining the variation of the ink pressure.

Further, the ink inflow channel 131*a* is communicated via a filter 136 with an ink communication channel 132*a* formed in the reservoir base 132. In normal recording, the ink supplied from the ink supply unit 10 flows into the ink inflow channel 131*a*, then passes through the filter 136, and finally flows into the ink communication channel 132*a*.

The ink discharge channel 131*b* is communicated with the ink inflow channel 131*a* at a position located on an upstream side of the filter 136 and is connected to the ink supply unit 10 via the ink discharge opening 130*b* and the ink discharge tube 11*b*. In a lower portion of an inner wall face of the ink discharge channel 131*b* is formed a hole 137*b* which extends through the outer wall face of the upper reservoir 131. The hole 137*b* is sealed by a flexible resin film 137*a* from a side thereof nearer to a lower outer wall face of the upper reservoir 131. The resin film 137*a* defines a part of the inner wall face of the ink discharge channel 131*b*. The resin film 137*a* is displaced with a variation of an ink pressure in the ink discharge channel 131*b*, thereby functioning as a damper for restraining the variation of the ink pressure. It is noted that, in ink circulation which will be explained below, the ink supplied from the ink supply unit 10 flows into the ink inflow channel 131*a* via the ink supply opening 130*a*, then passes through the ink discharge channel 131*b*, and finally flows into the ink supply unit 10 via the ink discharge opening 130*b*.

The air inflow channel 131*c* is a channel into which the humidified air supplied from the humidifier unit 60 flows via the air supply tube 11*c* and the air supply opening 130*c*. The air inflow channel 131*c* is communicated with an air communication channel 132*c* formed in the reservoir base 132. The air discharge channel 131*d* is connected to the humidifier unit 60 via the air discharge opening 130*d* and the air discharge tube 11*d*. The air discharge channel 131*d* is communicated with an air communication channel 132*d* formed in the reservoir base 132.

In the reservoir base 132, there are formed (a) the ink communication channel 132*a* partly constituting the ink channels and (b) two air communication channels 132*c*, 132*d* partly constituting the air channels. In the lower reservoir 133, there are formed (a) a main channel 133*a* partly constituting the ink channels, (b) ten branch channels 133*b* branched from the main channel 133*a*, and (c) two air communication channels 133*c*, 133*d* partly constituting the air channels. The ink having flowed from the ink communication channel 132*a* flows into the main channel 133*a*. The branch channels 133*b* are respectively communicated with ink supply openings 140*a* formed in the upper face of the channel unit 140. The air communication channels 133*c*, 133*d* are respectively communicated with the air communication channels 132*c*, 132*d* formed in the reservoir base 132. The air communication channels 133*c*, 133*d* are respectively communicated with an air supply opening 140*c* and an air discharge opening 140*d* formed in the upper face of the channel unit 140.

The ink supplied from the ink supply opening 130*a* flows into the channel unit 140 through the ink inflow channel 131*a*, the ink communication channel 132*a*, the main channel 133*a*, and the branch channels 133*b* formed in the reservoir unit 130. The ink passes through the filter 136 on its way to the channel unit 140. The filter 136 is used to catch foreign materials in the ink. Further, the humidified air is supplied toward the channel unit 140 via the air inflow channel 131*c* and the air communication channels 132*c*, 133*c* formed in the reservoir unit 130. On the other hand, the air sucked from the channel unit 140 is discharged to the humidifier unit 60 via the air communication channels 133*d*, 132*d*, the air discharge channel 131*d*, the air discharge opening 130*d*, and the air discharge tube 11*d*.

As shown in FIGS. 6A-6C, the head 1 includes the liquid absorbing member 180 provided in the accommodating space 111. The liquid absorbing member 180 is formed of a porous material such as a sponge, and is capable of absorbing liquid by contacting the liquid and capable of vaporizing the absorbed liquid by contacting a gas. The liquid absorbing member 180 has a generally rectangular parallelepiped shape and contacts and covers an entire outer surface of a lower end portion (i.e., a lowermost portion) of each of the ink supply tube 11*a*, the ink discharge tube 11*b*, the air supply tube 11*c*, and the air discharge tube 11*d* in the accommodating space 111. As a result, even where condensation has occurred on the outer surface of each tube 11*a*-11*d* in the accommodating space 111, the liquid absorbing member 180 can effectively absorb the condensation. That is, even where the condensation has been formed or caused on the tubes 11*a*-11*d* above the liquid absorbing member 180 in the accommodating space 111, the condensation flows downward along the outer surface of each tube 11*a*-11*d* and then is absorbed into the liquid absorbing member 180. Thus, it is possible to prevent the condensation from flowing from the reservoir unit 130 onto the channel unit 140. Accordingly, it is possible to prevent corrosion of metal components of the channel member 2 and to prevent a failure of the electronic parts fixed to the channel unit 140 (such as the actuator units 120 and the driver ICs 160) due to attachment or adhesion of the condensation. Further, the portion of each tube 11*a*-11*d* which is covered by the liquid absorbing member 180 is a connection portion connected to the corresponding opening 130*a*-130*d*. Accordingly, even where a very small amount of the ink and/or the humidified air has been leaked from the connection portion, the liquid absorbing member 180 can effectively absorb the ink and/or the humidified air and vaporize the absorbed ink and/or air to an outside of the cover member 110.

As shown in FIGS. 6A and 6B, about a half of each of side faces of the liquid absorbing member 180 in the sub-scanning direction is held in contact with an inner face of the corresponding heat sink 150. Thus, heat of the heat sinks 150 heated by heat generated by the corresponding driver ICs 160 facilitates vaporizing the liquid absorbed into the liquid absorbing member 180. It is noted that the liquid absorbing member 180 and the driver ICs 160 are distant from each other. In addition, the liquid absorbing member 180 is disposed at a position facing an entirety of the through holes 151 of the respective heat sinks 150. That is, the liquid absorbing member 180 is disposed so as to cover and close the entirety of the through holes 151. As a result, when the through holes 151 are seen from an outside of the cover member 110, a part of the liquid absorbing member 180 is exposed from the through holes 151. In other words, as shown in FIG. 6C, the liquid absorbing member 180 is provided so as to contact the head cover 115 of the cover member 110, an inner face of each heat sink 150, and an inner circumferential face of the through hole 151, and the liquid absorbing member 180 is flush with an outer face of the cover member 110. Accordingly, it is possible to effectively vaporize the liquid absorbed by the liquid absorbing member 180 to the outside of the cover member 110. Further, since the liquid absorbing member 180 covers the entirety of the through holes 151, foreign materials (such as liquid and dust) are less likely to enter from the through holes 151 into the accommodating space 111. It is noted that the liquid absorbing member 180 is preferably provided so as to fill the through hole 151, but is not limited to this arrangement as long as the liquid absorbing member 180 is provided so as to cover at least an entirety of the opening 151*a* opened inside the heat sink 150. That is, the through hole 151 does not need to be filled with the liquid absorbing member 180.

As a modification, this printer 101 may be configured such that through hole(s) are formed in the head cover 115 (the side walls 116) without forming the through holes 151 in the heat sinks 150, and the liquid absorbing member is disposed so as to cover at least part of the through hole(s). Also in this configuration, the liquid absorbing member is exposed to the outside of the cover member 110, thereby making it possible to vaporize the liquid absorbed by the liquid absorbing member 180 to the outside of the cover member 110.

Further, as shown in FIGS. 2 and 6C, the through holes 151 are provided near contact portions of the tubes 11*a*-11*d* and the liquid absorbing member 180. In the present embodiment, each through hole 151 is formed near an end portion of the corresponding heat sink 150 which is nearer to the tubes 11*a*-11*d*. As apparent from FIG. 2, a distance between the through hole 151 and the tubes 11*a*-11*d* is smaller than a distance between the through hole 151 and the driver IC 160. Accordingly, the condensation generated on the tubes 11*a*-11*d* is absorbed by the liquid absorbing member 180, then passes through the through holes 151 formed near the tubes 11*a*-11*d*, and vaporized to an outside of the cover member 110, making it possible to effectively vaporize the condensation to the outside of the cover member 110. Further, as shown in FIGS. 6A and 6C, each through hole 151 is provided at a position nearer to the ink supply tube 11*a* than the ink discharge tube 11*b*. In other words, the distance between the through hole 151 and the ink supply tube 11*a* is smaller than a distance between the through hole 151 and the ink discharge tube 11*b*. Comparing the ink supply tube 11*a* and the ink discharge tube 11*b*, the condensation is more likely to occur on the ink supply tube 11*a* than on the ink discharge tube 11*b* because the ink is supplied to the ink supply tube 11*a* from the outside of the ink-jet head. In the present embodiment, since the through holes 151 are formed near the ink supply tube 11*a*, it is possible to effectively vaporize the condensation generated on the ink supply tube 11*a* to the outside of the cover member 110.

Figure 8:
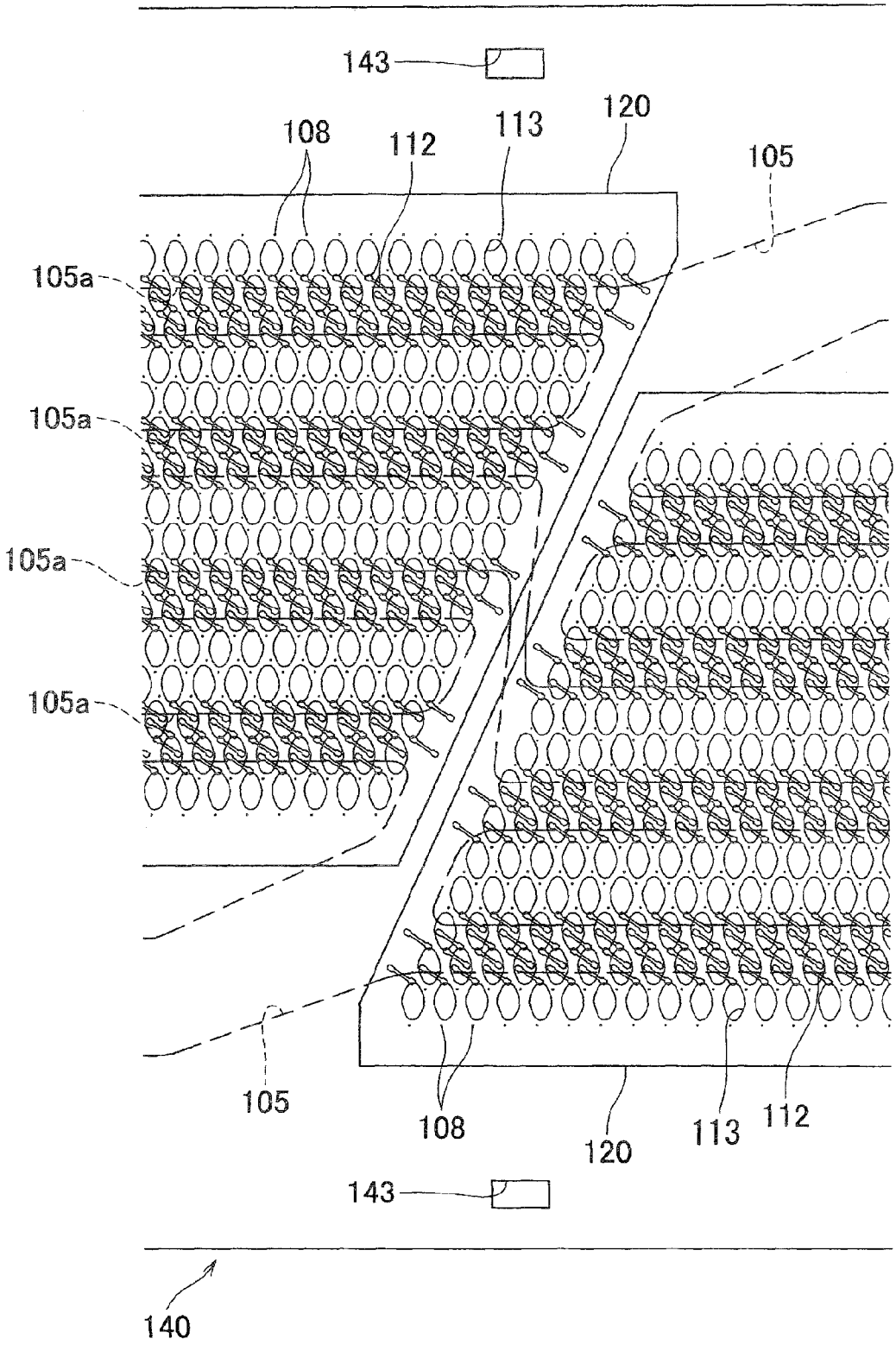
FIG. 8 is an enlarged view of an area enclosed with a one-dot chain line in FIG. 7.

There will be next explained the channel unit 140 and the actuator units 120 with reference to FIGS. 8 and 9. It is noted that, in FIG. 8, pressure chambers 113, apertures 112, and the ejection openings 108 are illustrated by solid lines for easier understanding purposes though these elements are located under the actuator units 120 and thus should be illustrated by broken lines.

The channel unit 140 includes therein (a) the ink channels including the pressure chambers 113 and so on and (b) the air channels through which the humidified air flows. Each of the actuator units 120 includes a plurality of unimorph actuators respectively corresponding to the pressure chambers 113. In the ejection of the ink, the control board 170 and the driver ICs 160 are controlled by a command from the controller 100, and a drive signal is supplied to each actuator from a corresponding one of the driver ICs 160, whereby ejection energies are selectively applied to the ink in the pressure chambers 113. As a result, the ink is ejected from the ejection openings 108 of the head 1.

The channel unit 140 is a stacked body constituted by a plurality of metal plates formed by stainless steel and positioned or aligned with one another. As shown in FIG. 7, in the upper face of the channel unit 140, there are opened (a) the ten ink supply openings 140*a* each communicated with a corresponding one of the branch channels 133*b* of the reservoir unit 130, and (b) the air supply opening 140*c* and the air discharge opening 140*d* respectively communicated with the air communication channels 133*c*, 133*d* of the reservoir unit 130. Further, in the channel unit 140, there are formed (a) the ink supply openings 140*a*, (b) manifold channels 105, (c) sub-manifold channels 105*a* included in each manifold channel 105, and (d) individual ink channels branched from each sub-manifold channel 105*a*. The ejection openings 108 are formed in the ejection face 2*a* so as to be arranged in matrix. The ejection openings 108 are arranged at positions respectively coinciding with the actuator units 120 in the vertical direction.

There will be next explained a flow of the ink in the channel unit 140. As shown in FIGS. 7 and 8, the ink supplied from the branch channels 133*b* of the reservoir unit 130 to the ink supply openings 140*a* flows or is distributed into the sub-manifold channels 105*a* of the manifold channels 105. The ink in the sub-manifold channels 105*a* flows into the individual ink channels in which the ink flows to the respective ejection openings 108 via the respective pressure chambers 113. As thus described, in the channel member 2, there are formed (a) the ink channels of the channel unit 140 described above, and (b) the ink channels (the liquid channels) including the ink inflow channel 131*a*, the ink communication channel 132*a*, the main channel 133*a*, and the branch channels 133*b* of the reservoir unit 130 and extending from the ink supply opening 130*a* to the ejection openings 108.

As shown in FIG. 5, an air supply channel 141 (as an example of a first air channel) and an air discharge channel 142 (as an example of a second air channel) are formed in the channel unit 140. The air supply channel 141 extends from the air supply opening 140*c* toward the ejection face 2*a* in the vertical direction, and the air discharge channel 142 extends from the air discharge opening 140*d* toward the ejection face 2*a* in the vertical direction. Further, an air jet opening 141*a* communicated with the air supply channel 141 and an air suction opening (sucking opening) 142*a* communicated with the air discharge channel 142 are formed in the ejection face 2*a*. The air jet opening 141*a* is formed in one of opposite end portions of the ejection face 2*a* in the main scanning direction, and the air suction opening 142*a* is formed in the other of the opposite end portions of the ejection face 2*a*. The ejection openings 108 are arranged between the air jet opening 141*a* and the air suction opening 142*a*. It is noted that the air jet opening 141*a*, the air suction opening 142*a*, and all the ejection openings 108 are arranged in the ejection face 2*a* at positions covered by the cap 31.

There will be next explained a flow of the humidified air in the channel unit 140. As shown in FIG. 5, in the humidifying maintenance, the humidified air supplied from the air communication channel 133*c* to the air supply opening 140*c* passes through the air supply channel 141 and is jetted or ejected from the air jet opening 141*a*. In this operation, the ejection face 2*a* is covered by the cap 31, and accordingly the humidified air is jetted into a sealed space enclosed by the cap 31 and the ejection face 2*a*. The sealed space is thus kept in a humid state, retaining a humidity or moisture of the ink near the ejection openings 108. That is, a viscosity of the ink near the ejection openings 108 is less likely to be increased. Further, an air or a gas in the sealed space is sucked from the air suction opening 142*a* concurrently with the ejection of the humidified air into the sealed space, and then the air flows into the air communication channel 133*d* through the air discharge channel 142. As thus described, the channel member 2 includes the two air channels formed therein. The two air channels include (a) the air channel extending from the air supply opening 130*c* to the air jet opening 141*a* including the air inflow channel 131*c*, the air communication channels 132*c*, 133*c*, and the air supply channel 141, and (b) the air channel extending from the air suction opening 142*a* to the air discharge opening 140*d* including the air discharge channel 142, the air communication channels 133*d*, 132*d*, and the air discharge channel 131*d*.

There will be next explained the ink supply units 10 in detail. As shown in FIG. 5, the ink supply unit 10 includes a sub-tank 80, an ink supply tube (pipe) 81, a pump 82, and an opening and closing valve 83. The sub-tank 80 is a tank to which the ink supply tube 11*a* and the ink discharge tube 11*b* are connected. The ink supply tube 81 is also connected to the sub-tank 80. The pump 82 is provided on the ink supply tube 11*a* and functions as a liquid-supply portion. The valve 83 is provided on the ink discharge tube 11*b*. Operations of the pump 82 and the valve 83 are controlled by the controller 100.

The sub-tank 80 stores therein the ink to be supplied to the head 1. The ink stored in an ink tank 90 is supplied by a pump, not shown, through the ink supply tube 81 when necessary. The sub-tank 80 has an air communication opening 80*a* formed in an outer wall thereof. As a result, an air pressure in the sub-tank 80 always becomes an atmospheric pressure regardless of an amount of the ink stored in the sub-tank 80, thereby enabling stable ink supply.

The pump 82 functions as a supply portion which is driven to force the ink in the sub-tank 80 to be supplied to the ink inflow channel 131*a* via the ink supply tube 11*a*. In addition, the pump 82 functions as a check valve for preventing the ink from flowing toward the sub-tank 80 in the ink supply tube 11*a*. The pump 82 is a three-phase diaphragm pump as a displacement pump, and three diaphragms are driven in different phases, thereby restraining a pressure variation upon the ink supply. The valve 83 is an adjusting or regulating valve for adjusting an amount of the ink to flow in the ink discharge tube 11*b*.

There will be next explained an ink circulation operation. The ink circulation operation is a part of a maintenance operation and is started when the ink-jet printer 101 has been turned on, when a waiting time has exceeded a specific length of time, or when a user has commanded to perform the circulation operation. In waiting or the normal recording, the pump 82 is stopped and the valve 83 is closed. It is noted that even where the pump 82 is stopped, the ink in the sub-tank 80 can be supplied to the reservoir unit 130 through the ink supply tube 11*a* where an amount of the ink is a relatively small amount required for the recording.

When the ink circulation operation has been started, the controller 100 opens the valve 83 and then drives the purge pump 82. As a result, the ink in the sub-tank 80 is forced to be supplied to the ink inflow channel 131*a* through the ink supply tube 11*a*. In this operation, since the valve 83 is opened, a resistance of a channel extending from the ink inflow channel 131*a* to the sub-tank 80 through the ink discharge channel 131*b* and the ink discharge tube 11*b* is smaller than that of a channel extending from the ink inflow channel 131*a* to the ejection openings 108. Thus, the ink supplied to the ink inflow channel 131*a* passes through the ink discharge channel 131*b* and the ink discharge tube 11*b* in order and flows back to the sub-tank 80 without flowing into the ink communication channel 132*a* by passing through the filter 136. In this ink circulation operation, an air and foreign materials in the ink inflow channel 131*a* (an air and foreign materials on the filter 136 in particular) pass through the ink discharge channel 131*b* and the ink discharge tube 11*b* together with the ink and are trapped in the sub-tank 80. After the ink circulation operation has been performed for a predetermined length of time, the controller 100 stops the pump 82 and then closes the valve 83. As a result, the ink circulation operation is finished.

There will be next explained the humidifier unit 60 in detail. As shown in FIG. 5, the humidifier unit 60 includes: a tank 61 to which the air supply tube 11*c* and the air discharge tube 11*d* are connected; and a pump 62 provided on the air discharge tube 11*d*. The pump 62 is controlled by the controller 100. To the tank 61 are connected all the air supply tubes 11*c* and the air discharge tubes 11*d* respectively connected to the four heads 1.

The tank 61 stores water at its lower space and stores, at its upper space, the humidified air humidified or moisturized by the water in the lower space. The air discharge tube 11*d* is connected to the tank 61 at a position below a water surface in the tank 61 so as to be communicated with the lower space of the tank 61. The air supply tube 11*c* is connected to the tank 61 at a position above the water surface in the tank 61 so as to be communicated with the upper space of the tank 61. It is noted that a check valve, not shown, is mounted on the air discharge tube 11*d* between the tank 61 and the pump 62 in order to prevent the water in the tank 61 from flowing into the pump 62, allowing the air to flow from the air discharge tube 11*d* to the air supply tube 11*c* via the tank 61.

There will be next explained a humidifying maintenance operation. This humidifying maintenance operation is also a part of the maintenance operation and is performed when the ink has not been ejected for a specific length of time, for example.

As shown in FIG. 5, when the humidifying maintenance operation has been started, the controller 100 controls the cap moving mechanism, not shown, to move the cap 31 to a position at which the cap 31 contacts the ejection face 2*a*. As a result, the space enclosed by the cap 31 and the ejection face 2*a* becomes the sealed space.

The controller 100 then drives the pump 62 to suck the air in the sealed space from the air suction opening 142*a*. In this operation, the air sucked from the air suction opening 142*a* is discharged to the tank 61 by passing through the air discharge channel 142, the air discharge opening 140*d*, the air communication channels 133*d*, 132*d*, the air discharge channel 131*d*, the air discharge opening 130*d*, the air discharge tube 11*d*, and the pump 62. The air is supplied to the lower space of the tank 61 (located beneath the water surface). Then, the air humidified by the water in the tank 61 is discharged from the upper space of the tank 61 and supplied into the sealed space through the air supply tube 11*c*, the air supply opening 130*c*, the air inflow channel 131*c*, the air communication channels 132*c*, 133*c*, the air supply opening 140*c*, the air supply channel 141, and the air jet opening 141*a*. Since the humidified air is supplied into the sealed space enclosed by the cap 31 and the ejection face 2*a* in this manner, it is possible to restrain thickening of the ink near the ejection openings 108, thereby preventing clogging of the ejection openings 108. Further, even where the viscosity of the ink near the ejection openings 108 has been increased, water or moisture is supplied by the humidified air, thereby removing or recovering the increased viscosity of the ink.

After the pump 62 has been driven for a certain length of time, the controller 100 stops the driving of the pump 62. The controller 100 then controls the cap moving mechanism such that each cap 31 is moved to a retracted position at which each cap 31 is distant from the corresponding ejection face 2*a*. As a result, the humidifying maintenance operation is finished, enabling the recording operation of the head 1.

As described above, according to the heads 1 and the printer 101 as the present embodiment, even where the condensation has occurred on the outer surface of the ink supply tube 11*a* in the accommodating space 111 in the cover member 110, the liquid absorbing member 180 can absorb the condensation and vaporize the absorbed condensation to an outside of the cover member 110 via the through holes 151. Accordingly, it is possible to prevent the failure of the electronic parts (such as the driver ICs 160 and the control board 170) due to the attachment of the liquid to the electronic parts.

Further, in the humidifying maintenance operation for humidifying the ejection openings 108, even where the condensation has occurred on the surfaces of the air supply tube

11*c* and the air discharge tube 11*d* in the accommodating space 111 upon supplying or discharging the humidified air where a temperature of the humidified air is lower than that of an outside air in the cover member 110, the liquid absorbing member 180 can absorb the condensation and vaporize the absorbed condensation to the outside of the cover member 110 via the through holes 151. Accordingly, it is possible to prevent the failure of the electronic parts due to the attachment of the liquid to the electronic parts.

Further, in the construction in which the ink discharge tube 11*b* is connected to the channel member 2 in order to circulate the ink between a part of the ink channels of the channel member 2 and the sub-tank 80, even where a large amount of the ink having a temperature lower than that of the accommodating space 111 has been supplied from the sub-tank 80, and the condensation has occurred on the outer surfaces of the ink supply tube 11*a* and the ink discharge tube 11*b*, the liquid absorbing member 180 can absorb the condensation and vaporize the absorbed condensation to the outside of the cover member 110 via the through holes 151. Accordingly, it is possible to prevent the failure of the electronic parts due to the attachment of the liquid to the electronic parts.

While the embodiment of the present invention has been described above, it is to be understood that the invention is not limited to the details of the illustrated embodiment, but may be embodied with various changes and modifications, which may occur to those skilled in the art, without departing from the spirit and scope of the invention. For example, the liquid absorbing member may have any configuration as long as the part of the liquid absorbing member is exposed from the through hole formed in the cover member 110 while covering part of the outer surface(s) of less than four tubes of the ink supply tube 11*a*, the ink discharge tube 11*b*, the air supply tube 11*c*, and the air discharge tube 11*d* in the accommodating space 111. This configuration can achieve the same advantages as described above. Further, in the above-described embodiment, the connection portions of the respective tubes 11*a*-11*d* for the respective openings 130*a*-130*d* are located at the lowermost position in the accommodating space 111, but where the connection portions are not located at the lowermost position, but midway portions of the respective tubes 11*a*-11*d* are located at the lowermost position, the liquid absorbing member may be provided so as to cover the midway portions. Also in this configuration, the same advantages as described above can be obtained.

The present invention is applicable to any of a line printer and a serial printer. Further, the application of the present invention is not limited to the printer. That is, the present invention is also applicable to a facsimile machine, a copying machine, and the like. Further, the present invention is also applicable to a liquid ejection apparatus configured to eject liquid other than the ink to perform recording. Further, instead of the above-described piezoelectric type, the ejection-energy applying portion may be an electrostatic actuator, a thermal heating element, and the like.

What is claimed is:

1. A liquid ejection head comprising:

a channel member including:

a plurality of ejection openings for ejecting liquid;

a liquid channel communicated with the plurality of the ejection openings; and a liquid-supply opening for supplying the liquid to the liquid channel;

a liquid-supply pipe connected to the liquid-supply opening;

an ejection-energy applying portion fixed to the channel member and configured to apply an ejection energy to the liquid in the liquid channel for ejecting the liquid from the plurality of the ejection openings;

an electronic part, connected to the ejection-energy applying portion, for driving the ejection-energy applying portion;

a cover member held in contact with the channel member so as to form an accommodating space that is defined by the cover member and the channel member, the liquid-supply pipe extending into the accommodating space through the cover member, wherein the electronic part, at least a part of the liquid-supply pipe, and the liquid-supply opening are disposed in the accommodating space; and a liquid absorbing member disposed in the accommodating space so as to cover at least a part of a surface of the liquid-supply pipe;

wherein the cover member has a through hole formed therein for communicating the accommodating space with an outside of the cover member; and wherein a part of the liquid absorbing member is exposed to the outside of the cover member through the through hole.

2. The liquid ejection head according to claim 1, wherein the liquid absorbing member is configured to cover an entirety of an opening of the through hole, which opening is opened inside the cover member.

3. The liquid ejection head according to claim 1, wherein the liquid absorbing member is configured to cover a cylindrical surface of a lowermost portion of the liquid-supply pipe in the accommodating space.

4. The liquid ejection head according to claim 1, wherein the liquid absorbing member is configured to cover a connection portion at which the liquid-supply pipe and the liquid-supply opening are connected to each other.

5. The liquid ejection head according to claim 1, wherein a part of the cover member is thermally connected to the electronic part, and wherein the liquid absorbing member is held in contact with the part of the cover member in a state in which the liquid absorbing member is distant from the electronic part.

6. The liquid ejection head according to claim 5, wherein the cover member includes:

a heat sink as the part of the cover member; and a head cover provided on an upper side of the heat sink and configured to define the accommodating space with the heat sink.

7. The liquid ejection head according to claim 6, wherein the through hole is formed in the heat sink.

8. The liquid ejection head according to claim 1, wherein the through hole is formed near a contact portion at which the liquid-supply pipe and the liquid absorbing member are held in contact with each other.

9. The liquid ejection head according to claim 1, wherein the channel member includes:

a liquid-discharge opening for discharging the liquid from the liquid channel; and a liquid-discharge pipe, connected to the liquid-discharge opening, for discharging the liquid from the channel member to an outside thereof, wherein a distance between the through hole and the liquid-supply pipe is less than a distance between the through hole and the liquid-discharge pipe.

10. The liquid ejection head according to claim 1, wherein the channel member includes:

a jet opening through which is jetted a humidified air for humidifying the plurality of the ejection openings;

a first air channel communicated with the jet opening;

a humidified-air supply opening for supplying the humidified air to the first air channel;

a sucking opening for sucking the humidified air jetted from the jet opening;

a second air channel communicated with the sucking opening; and a humidified-air discharge opening for discharging the humidified air from the second air channel, wherein the liquid ejection head further comprises:

a humidified-air supply pipe connected to the humidified-air supply opening; and a humidified-air discharge pipe connected to the humidified-air discharge opening, wherein the accommodating space accommodates at least a part of at least one of the humidified-air supply pipe and the humidified-air discharge pipe, and wherein the liquid absorbing member is configured to partly cover a surface of the at least the part of the at least one of the humidified-air supply pipe and the humidified-air discharge pipe.

11. A liquid ejection head comprising:

a channel member including:

a plurality of ejection openings for ejecting liquid;

a liquid channel communicated with the plurality of the ejection openings;

a liquid-supply opening for supplying the liquid to the liquid channel;

a jet opening through which is jetted a humidified air for humidifying the plurality of the ejection openings;

a first air channel communicated with the jet opening;

a humidified-air supply opening for supplying the humidified air to the first air channel;

a sucking opening for sucking the humidified air jetted from the jet opening;

a second air channel communicated with the sucking opening; and a humidified-air discharge opening for discharging the humidified air from the second air channel;

wherein the liquid ejection head further comprises:

a liquid-supply pipe connected to the liquid-supply opening;

a humidified-air supply pipe connected to the humidified-air supply opening;

a humidified-air discharge pipe connected to the humidified-air discharge opening;

an ejection-energy applying portion fixed to the channel member and configured to apply an ejection energy to the liquid in the liquid channel for ejecting the liquid from the plurality of the ejection openings;

an electronic part, connected to the ejection-energy applying portion, for driving the ejection-energy applying portion;

a cover member held in contact with the channel member so as to form an accommodating space that is defined by the cover member and the channel member, the liquid-supply pipe extending into the accommodating space through the cover member, wherein the electronic part, at least a part of at least one of the humidified-air supply pipe and the humidified-air discharge pipe, and the liquid-supply opening are disposed in the accommodating space; and a liquid absorbing member disposed in the accommodating space so as to cover at least a part of the at least one of the humidified-air supply pipe and the humidified-air discharge pipe accommodated in the accommodating space;

wherein the cover member has a through hole formed therein for communicating the accommodating space with an outside of the cover member; and wherein a part of the liquid absorbing member is exposed to the outside of the cover member through the through hole.

12. A liquid ejection apparatus comprising:

the liquid ejection head according to claim 1;

a tank storing the liquid to be supplied to the liquid ejection head;

a liquid-supply portion configured to forcibly supply the liquid stored in the tank to the liquid-supply pipe;

a liquid-discharge opening, formed in the channel member of the liquid ejection head, for discharging the liquid from the liquid channel;

a liquid-discharge pipe connected to the liquid-discharge opening and communicated with the tank;

an opening and closing valve provided in the liquid-discharge pipe; and a controller configured to control a drive of the liquid-supply portion and the opening and closing valve;

wherein the controller is configured to drive the liquid-supply portion in a state in which the opening and closing valve is opened and to circulate the liquid such that the liquid passes through the tank, the liquid-supply pipe, the liquid channel, the liquid-discharge pipe, and the tank in order.

13. The liquid ejection head according to claim 1, wherein the liquid-supply pipe is connected to the liquid-supply opening such that the liquid is supplied from a liquid tank to the liquid channel through the liquid-supply pipe and the liquid-supply opening.

* * * * *